United States Patent [19]

Pollard

[11] 4,448,142

[45] May 15, 1984

[54] BOOM ASSEMBLY FOR SAILBOARD

[75] Inventor: Jerry B. Pollard, Woodinville, Wash.

[73] Assignee: The Coleman Company, Inc., Wichita, Kans.

[21] Appl. No.: 316,782

[22] Filed: Nov. 2, 1981

[51] Int. Cl.[3] ..... B63B 15/00

[52] U.S. Cl. ..... 114/39; 114/99

[58] Field of Search ..... 114/39, 89–99, 114/102, 103; 441/74

[56] References Cited

U.S. PATENT DOCUMENTS

| | | | |
|---|---|---|---|
| 3,986,722 | 10/1976 | Patterson | 114/103 |
| 4,319,536 | 3/1982 | Schweitzer et al. | 114/99 |
| 4,334,488 | 6/1982 | Jolivet | 114/39 |

FOREIGN PATENT DOCUMENTS

| | | | |
|---|---|---|---|
| 2912868 | 10/1980 | Fed. Rep. of Germany | 114/98 |
| 1123150 | 9/1956 | France | 114/39 |
| WO79/01078 | 12/1979 | PCT Int'l Appl. | 114/39 |
| 616374 | 3/1980 | Switzerland | 114/99 |

*Primary Examiner*—Galen L. Barefoot
*Assistant Examiner*—Stephen P. Avila

[57] ABSTRACT

A boom assembly is pivotally attached to the mast of a sailboard for pivotal movement between a use position and a storage position. The boom assembly includes a boom bracket and a pair of booms which are connected to the boom bracket. An elastic connecting member is attached to the bracket and is pivotally connected to the mast. The bracket includes a pair of camming surfaces which are engageable with the mast as the bracket moves from the storage position to the use position, and the camming surfaces tension the elastic connecting member to provide a frictional retention force between the camming surfaces and the mast which tends to retain the bracket in the use position.

3 Claims, 10 Drawing Figures

BOOM ASSEMBLY FOR SAILBOARD

BACKGROUND

This invention relates to a boom assembly for a sailboard, and, more particularly, to a boom assembly which is pivotally connected to the mast of a sailboard for pivotal movement between a storage position and a use position.

A sailboard typically includes a board which is adapted to support a user on water, a mast which is connected to the board, and a sail which is supported by the mast. One or more booms extend generally perpendicularly to the mast and provide both a handhold for the user and control over the sail. One such sailboard is described in U.S. Pat. No. 3,487,800.

Since the booms act as a kind of "steering wheel" in providing control over the sail and since the booms are the only handhold for the sailor, it is desirable that the booms be securely attached to the mast. In some sailboards the booms are permanently attached to the mast in order to provide the desired secure attachment. However, permanent attachment of the booms to the mast makes the mast-boom assembly bulky and difficult to transport. Structural failure can also result if excessive force is applied to the attachment between the booms and the mast.

In other sailboards the booms are tied to the mast with ropes or the like so that the booms can be removed from the mast after use. U.S. Pat. No. 3,487,800 illustrates one method of tying the booms to the mast. However, when the booms are tied to the mast, there is usually a certain amount of looseness or sloppiness in the connection, particularly since rope has a tendency to stretch when it is wet. Any sloppiness in the connection between the booms and the mast adversely affects control of the sail and overall performance. Tying the booms is also time-consuming and requires a certain amount of experience and expertise.

SUMMARY OF THE INVENTION

The invention provides a firm, secure attachment between the booms and the mast when the sailboard is being used but permits the booms to be pivoted to a relatively compact storage position in which the booms extend generally alongside the mast. The booms are attached to a boom bracket which is pivotally connected to the mast, and the boom bracket includes a pair of camming surfaces which provide a wedging action against the mast when the boom bracket is in its use position. An elastic connecting member extends between the boom bracket and the mast and is pivotally connected to the mast. The elastic connector is tensioned or preloaded by the wedging action of the camming surfaces to provide a frictional retention force which tends to retain the boom bracket in its use position. The retention force can be overcome when desired by applying a sufficient pivoting force to the boom bracket.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
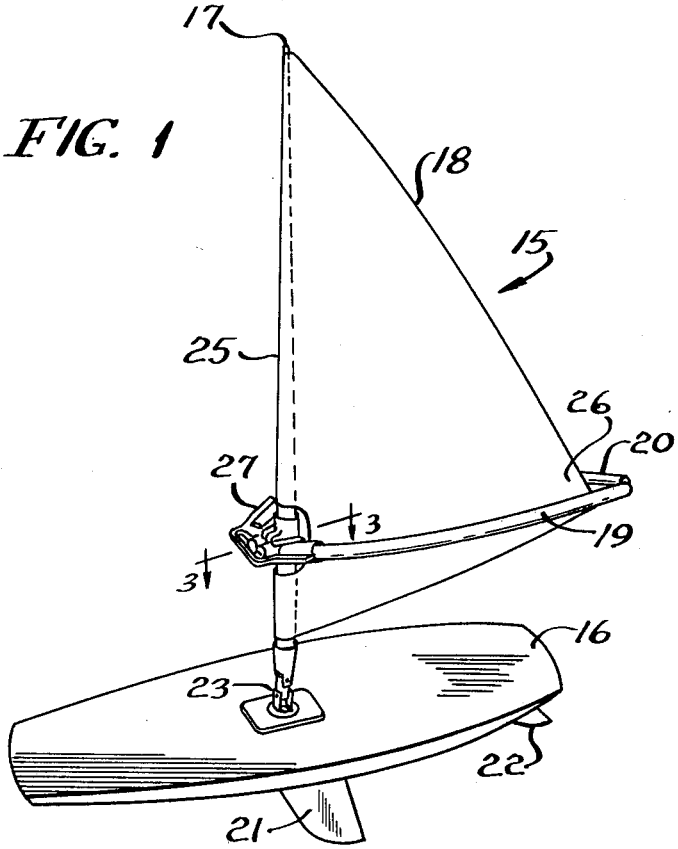
FIG. 1 is a perspective view of a sailboard equipped with a boom assembly in accordance with the invention.

Referring first to FIG. 1, the numeral 15 designates generally a sailboard apparatus which includes a sailing board 16, a mast 17, a sail 18, and a pair of booms 19 and 20. The board 16 is similar to a surfboard, and the particular board illustrated includes a daggerboard 21 and a fin 22. The mast 17 is usually pivotally connected to the board, and in the particular embodiment illustrated the mast is connected to the board by a universal joint 23.

The sail 18 is generally triangular and includes a luff sleeve 25 through which the mast extends and a clew 26. The booms 19 and 20 are connected to the boom bracket 27 and extend on opposite sides of the sail toward the clew. The aft ends of the boom can be tied to the clew in the conventional manner to maintain the sail relatively taut.

Figure 2:
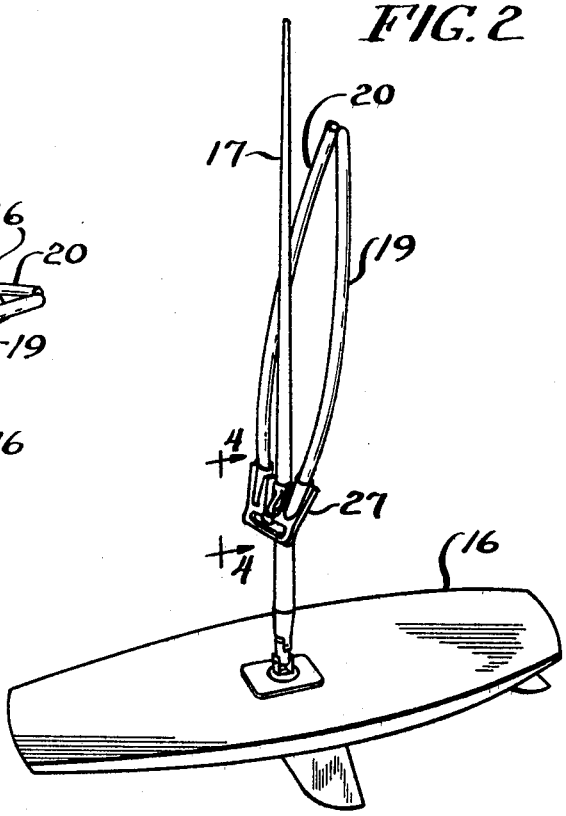
FIG. 2 is a perspective view showing the boom assembly in the storage position.

The boom bracket is pivotally connected to the mast and is pivotable between a use position illustrated in FIG. 1 and a storage position illustrated in FIG. 2 in which the booms extend generally parallel to and alongside the mast. The sail is omitted from FIG. 2 for clarity of illustration, and it is unnecessary to remove the sail from the mast before pivoting the boom bracket to the storage position. However, the ends of the booms should be disconnected from the clew of the sail before pivoting the boom bracket. When the boom bracket is in the storage position, the mast and boom assembly does not occupy significantly more space than the mast itself. The mast and boom assembly can be removed from the board and transported or stored in a compact manner.

Figure 3:
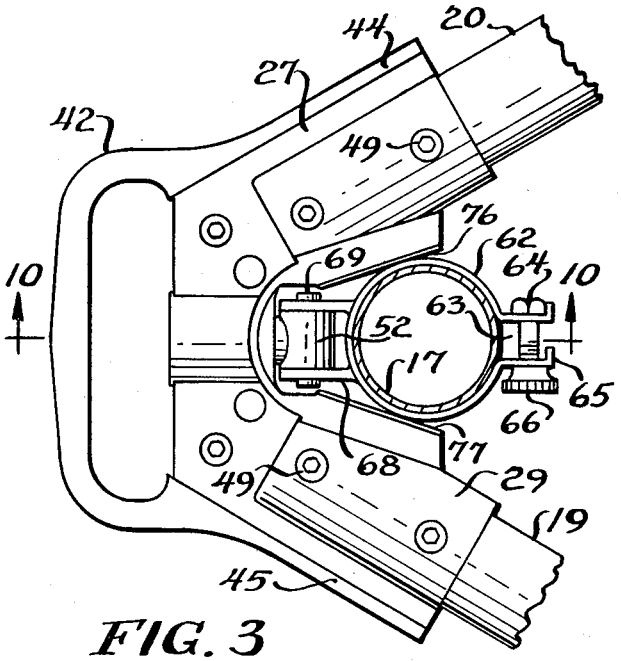
FIG. 3 is an enlarged fragmentary sectional view taken along the line 3—3 of FIG. 1.
Figure 4:
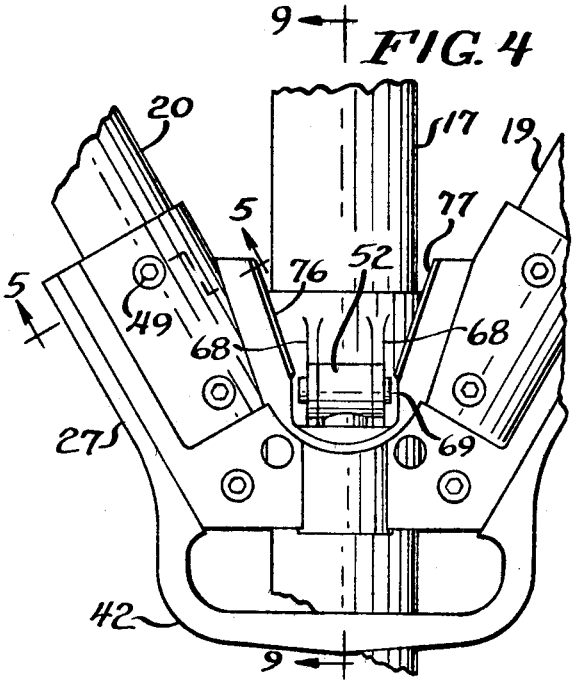
FIG. 4 is an enlarged fragmentary front elevational view of the boom assembly in its storage position as would be seen along the line 4—4 of FIG. 2.
Figure 5:
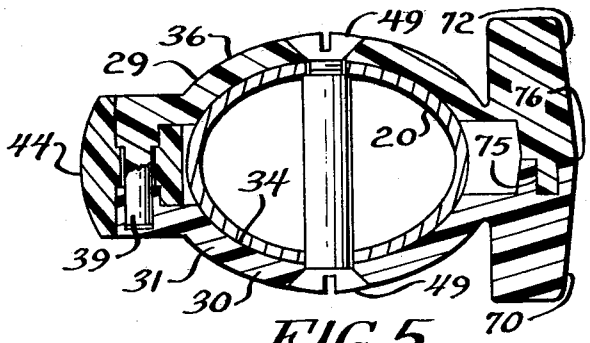
FIG. 5 is an enlarged sectional view taken along the line 5—5 of FIG. 4.
Figure 6:
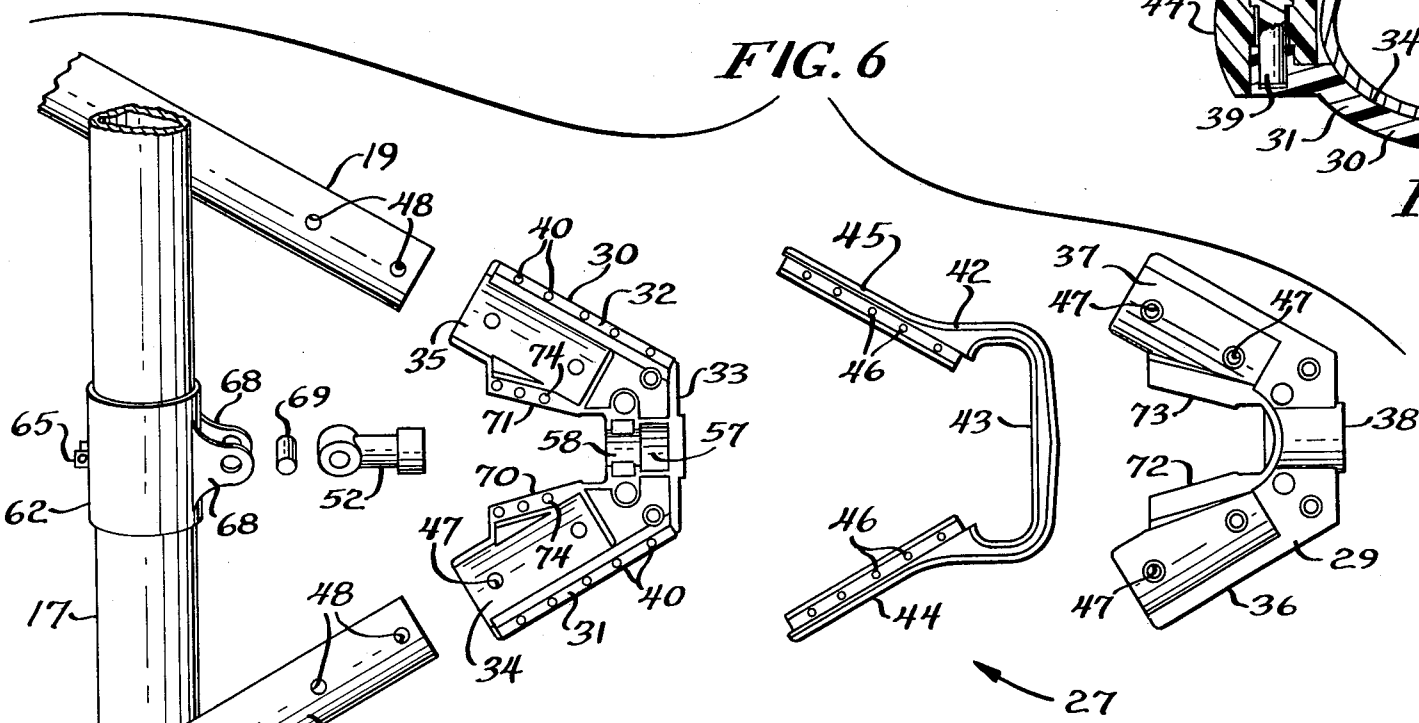
FIG. 6 is an exploded fragmentary view of the boom assembly.
Figure 8:
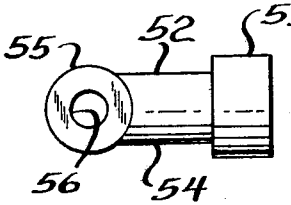
FIG. 8 is a side elevational view of the elastic connector taken along the line 8—8 of FIG. 7.
Figure 7:
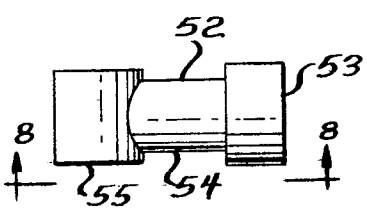
FIG. 7 is a top fan view of the elastic connector.
Figure 9:
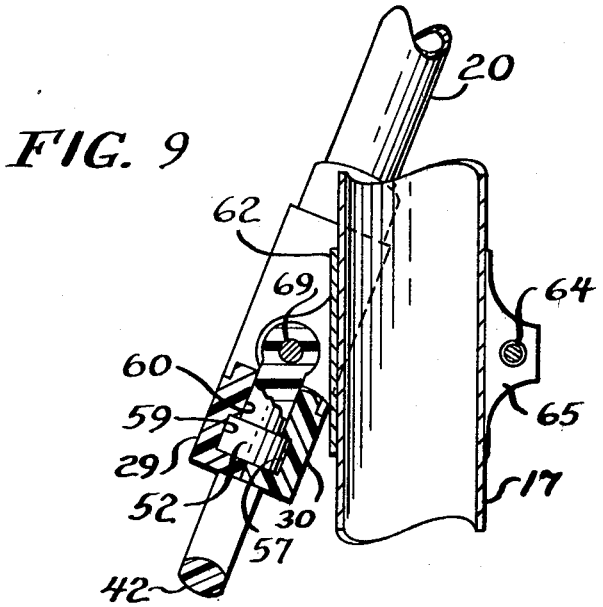
FIG. 9 is a fragmentary sectional view taken along the line 9—9 of FIG. 4.
Figure 10:
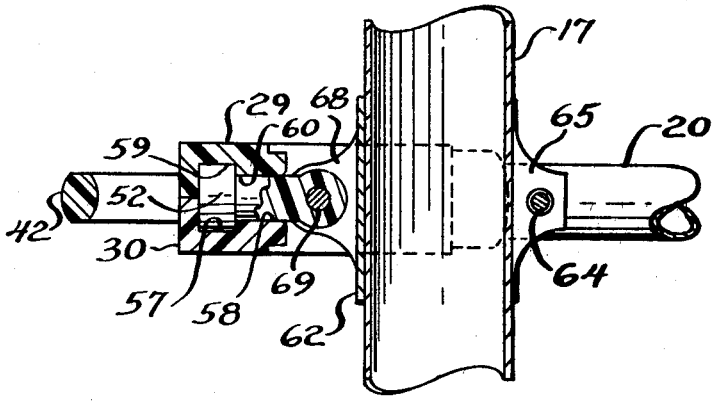
FIG. 10 is a fragmentary sectional view taken along the line 10—10 of FIG. 3.

Referring now to FIGS. 3 and 6, the boom bracket 27 includes a pair of generally V-shaped bracket halves 29 and 30 which enclose the forward ends of the booms 19 and 20. The lower bracket half 30 includes a pair of diverging leg portions 31 and 32 and a forward connecting portion 33. Semicylindrical recess 34 (see also FIG. 5) is formed in the leg portion 31 for the boom 20, and a semicylindrical recess 35 is formed in the leg portion 32 for the boom 19. The upper bracket half 29 similarly includes a pair of diverging leg portions 36 and 37, which are provided with semicylindrical recesses, and a forward connecting portion 38. The leg portions 36 and 37 include downwardly extending pins 39 (FIG. 5) along their outer edges which fit into counterbores or openings 40 (FIG. 6) in the leg portions 31 and 32 of the lower bracket half.

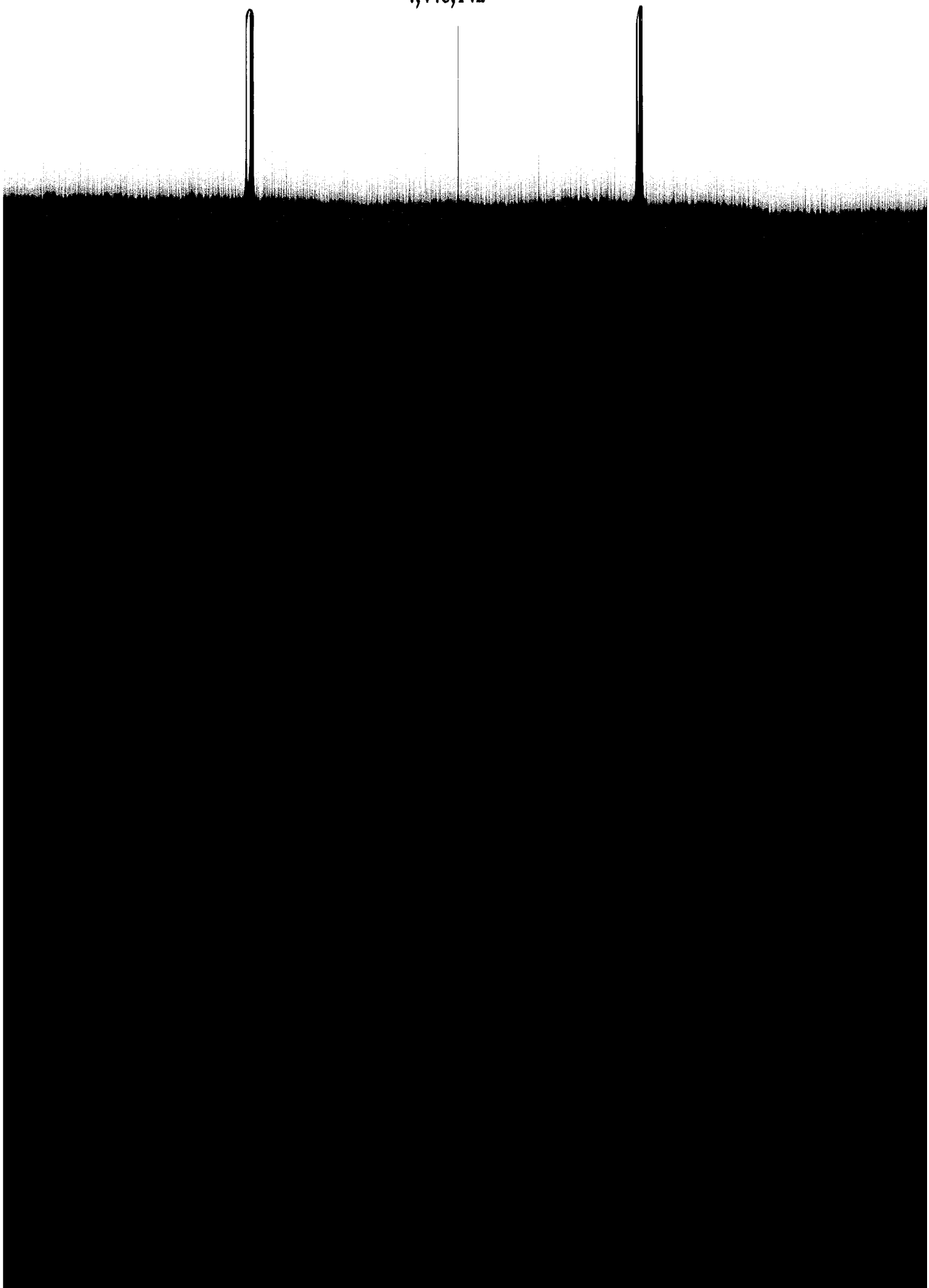

In one specific embodiment of the invention the elastic connector 52 was molded from polyurethane and had a durometer rating of 55D. The boom bracket halves were injection molded from glass fiber filled nylon.

The position of the holes in the ears 68 on the mast clamp through which the pivot pin is inserted can be varied to vary the preload force as desired. In one specific embodiment the preload force was set at 50 lbs. The preload force can also be varied by changing the material from which the elastic connector is made.

In the preferred embodiment of the invention the camming surfaces of the boom bracket are relatively hard and remain substantially undeformed by the forces involved so that the contact between the camming surfaces and the mast clamp occurs primarily at the ridges 76 and 77. However, if a non-elastic connector were used, softer material which is deformable and resilient could be used for the camming surfaces so that the material could deform to permit the boom bracket to move to the use position.

Although I have described the boom bracket as having two booms attached thereto, it is possible to manipulate a sailboard with only one boom. The single boom would be attached to one of the legs of the boom bracket, and the V-shaped camming surfaces would operate in the same way as previously described.

In the specific embodiment of the invention described herein the boom bracket was attached to the mast by a mast clamp and the camming surfaces of the bracket engaged the mast clamp. However, the boom bracket could be attached directly to the mast and the camming surfaces could engage the mast itself. Since the mast clamp forms an extension of the mast, it should be considered a part of the mast for purposes of interpreting the scope of the claims hereof.

While in the foregoing specification a detailed description of a specific embodiment of the invention was set forth for the purpose of illustration, it will be understood that many of the details hereingiven may be varied considerably by those skilled in the art without departing from the spirit and scope of the invention.

I claim:

1. In a sailboard assembly having a board adapted to support a user on water, a mast connected to the board, and a sail supported by the mast, an improved boom assembly comprising a boom support bracket having a pair of mast-engaging surfaces, at least one boom connected to the boom bracket, and an elastic connecting member mounted on the boom bracket between the mast-engaging surfaces and extending toward the mast for pivotally connecting the boom bracket to the mast, the connecting member including a first end which is pivotally connected to the mast for pivoting movement about a first axis which extends perpendicularly to the axis of the mast and a second end which is pivotally connected to the boom bracket for pivoting movement about a second axis which extends perpendicularly to said first axis, the boom bracket being pivotable with respect to the mast between a use position in which the boom extends generally perpendicularly to the mast and the mast-engaging surfaces engage the mast and frictionally retain the boom bracket in the use position and a storage position in which the boom extends at less than 90° with respect to the mast, the elastic connecting member being tensioned with the boom bracket is in the use position to provide a frictional retention force between the mast-engaging surfaces and the mast.

2. The structure of claim 1 in which the mast-engaging surfaces extend angularly with respect to each other to provide a wedging action on the mast as the boom bracket moves from its storage position to its use position which tensions the elastic member.

3. A sailboard assembly having a board adapted to support a user on water, a mast connected to the board, and a sail supported by the mast and extending from one side thereof and terminating in a clew, an improved boom assembly comprising a boom bracket pivotally connected to the mast on the side opposite the sail, a pair of curved booms extending on opposite sides of the mast from the boom bracket to the clew of the sail, each boom having a first end connected to the boom bracket and a second end connected to the clew of the sail, the boom bracket having a pair of camming surfaces spaced inwardly of the booms, the boom bracket being pivotable with respect to the mast between a use position in which the booms extend in a plane which is generally perpendicular to the mast and the camming surfaces engage the mast and frictionally retain the boom bracket in the use position and a storage position in which the booms extend in a plane which extends at less than a 90° angle with respect to the mast, the improvement comprising an elastic connecting member having a generally cylindrical head which is pivotally encased within the boom bracket between the camming surfaces and a shank which extends from the cylindrical head toward the mast and is pivotally connected to the mast for pivoting movement about an axis which extends perpendicularly to the axis of the mast, the elastic connecting member being tensioned when the boom bracket is in the use position to provide a frictional retention force between the camming surfaces and the mast.

* * * * *